US005927393A

United States Patent [19]

Richter et al.

[11] Patent Number: 5,927,393

[45] Date of Patent: Jul. 27, 1999

[54] HEAT EXCHANGER FIN WITH ENHANCED CORRUGATIONS

[75] Inventors: Ira Z. Richter, Lilburn, Ga.; Larry L. Shanks, Danville, Ill.

[73] Assignee: Heatcraft Inc., Grenada, Miss.

[21] Appl. No.: 08/988,581

[22] Filed: Dec. 11, 1997

[51] Int. Cl.[6] ..... F28D 1/04

[52] U.S. Cl. ..... 165/151; 165/182; 165/DIG. 504

[58] Field of Search ..... 165/151, 181, 165/182

[56] References Cited

U.S. PATENT DOCUMENTS

| | | | |
|---|---|---|---|
| 3,645,330 | 2/1972 | Albright et al. | 165/151 |
| 4,860,822 | 8/1989 | Sacks | 165/151 |
| 5,056,594 | 10/1991 | Kraay | 165/151 |
| 5,062,475 | 11/1991 | Bemisderfer et al. | 165/151 |
| 5,111,876 | 5/1992 | Nash | 165/151 |
| 5,168,923 | 12/1992 | Sacks | 165/151 |
| 5,203,403 | 4/1993 | Yokoyama et al. | 165/151 |
| 5,207,270 | 5/1993 | Yokoyama et al. | 165/151 |

*Primary Examiner*—Leonard Leo
*Attorney, Agent, or Firm*—W. Kirk McCord

[57] ABSTRACT

A heat exchanger fin having enhanced corrugations is provided. The corrugations define a generally sinusoidal wave pattern in a transverse direction across the fin. The fin is particularly well-suited for use in a heat exchanger, such as an evaporator or condenser, in a refrigeration system where the spacing between adjacent fins tends to be greater than in an air conditioning system. For example, when the spacing between adjacent fins is in a range from about 2 to 8 fins per inch, the height of the corrugations is greater than the fin spacing. The greater corrugation height bends the air passing between adjacent fins to a greater extent than prior art corrugated fins, thereby causing a greater volume of air to follow the contours of the corrugations and to come into contact with the surfaces of the fins to enhance heat transfer between the air and the fins. Further, the airflow upstream of the fin collars is defined by a larger vortices than in prior art corrugated fins, which further improves heat transfer. Further, this improved heat transfer is achieved without any appreciable air side pressure loss.

14 Claims, 5 Drawing Sheets

HEAT EXCHANGER FIN WITH ENHANCED CORRUGATIONS

TECHNICAL FIELD

This invention relates generally to heat exchanger fins and in particular to an improved corrugated fin for use in a heat exchanger.

BACKGROUND ART

So-called finned tube heat exchangers are widely used in a variety of applications in the fields of refrigeration, air conditioning and the like. Such heat exchangers are comprised of a plurality of spaced parallel tubes in which a first heat transfer fluid, such as water, oil, air or refrigerant, flows while a second heat transfer fluid, such as air, is directed across the outside of the tubes. To improve heat transfer between the first and second fluids, a plurality of fins comprising thin sheets of metal are placed on the tubes. Each fin has a plurality of openings through which the tubes pass generally at right angles to the fins and a large number of fins are arranged in generally parallel, closely spaced relationship along the tubes to form multiple paths for the second heat transfer fluid to flow across the fins and around the tubes.

The design of the fins is a critical factor in the heat transfer efficiency of the heat exchanger. Numerous fin designs have been proposed to enhance heat transfer efficiency, compactness and manufacturability of finned tube heat exchangers. Many of these designs have involved enhancements to the fins, such as interrupting the fins with a plurality of louvers or defining corrugations on the surface of the fins, to cause numerous disruptions of the hydrodynamic boundary layers which form with increasing thickness along the fins and decrease heat transfer efficiency.

Although it is known in the art that heat transfer efficiency can be increased in a finned tube heat exchanger by adding various fin enhancements such as louvers and corrugations to interrupt the flow of air between the fins, such prior art enhancements typically have the undesirable effect of increasing air side pressure drop as air flows through the heat exchanger. There is, therefore, a need for an improved heat exchanger fin which substantially enhances heat transfer efficiency without substantially increasing air side pressure drop.

SUMMARY OF THE INVENTION

In accordance with the present invention, a heat exchanger is provided having plural fins arranged in substantially parallel array and plural heat transfer tubes passing through respective aligned openings in the fins and in intimate contact therewith to allow a heat transfer medium flowing inside the tubes to exchange heat with another heat transfer medium flowing across the fins on the outside of the tubes. Each fin is comprised of a relatively flat sheet of heat conductive material having plural collars formed around respective openings in the fin. The collars have respective annular base portions, which define a nominal plane of the fin. In accordance with a feature of the invention, the sheet is formed into corrugations defining a predetermined wave pattern across a minor dimension of the fin (i.e., across the width of the fin). A first portion of the corrugations is above the nominal plane of the fin and a second portion of the corrugations is below the nominal plane. The first portion of the corrugations corresponds to a crest of the wave pattern and the second portion of the corrugations corresponds to a trough of the wave pattern. The fin is shaped around the annular base portion of each collar thereon in the form of a shallow, semi-annular first frustoconical region that slopes upwardly from the base portion to the first portion of the corrugations on one side of a longitudinal axis of the fin and a shallow, semi-annular second frusto-conical region that slopes downwardly from the base portion to the second portion of the corrugations on an opposite side of the longitudinal axis.

In accordance with another feature of the invention, the corrugations have a height, as measured in a direction normal to the nominal plane of the fin, which is greater than a spacing between adjacent fins. In accordance with a preferred embodiment of the invention, the spacing between adjacent fins is in a range from about 2 to 8 fins per inch. Further, in accordance with a preferred embodiment of the invention, the corrugations define a generally sinusoidal wave pattern across the minor dimension of the fin.

The height of the corrugations is more pronounced than in prior art fins. For example, in a heat exchanger used as an evaporator in a refrigeration system, the spacing between adjacent fins may be about 0.166 inch. When fins according to the present invention are used, the corrugations may have a height of about 0.200 inch (i.e. about twice the height of the corrugations in prior art fins having about the same fin spacing). It is believed that the higher corrugations cause a greater bending of the air as it passes between the fins of the heat exchanger, which results in a greater volume of air following the contours of the corrugations and being in contact with the fin surfaces for enhanced heat transfer. A major advantage of the present invention is that heat transfer is substantially enhanced without substantially increasing air side pressure drop across the heat exchanger.

BEST MODE FOR CARRYING OUT THE INVENTION

In the description which follows, like parts are marked throughout the specification and drawings with the same respective reference numbers. The drawings are not necessarily to scale and in some instances proportions may have been exaggerated in order to more clearly depict certain features of the invention.

Figure 1:
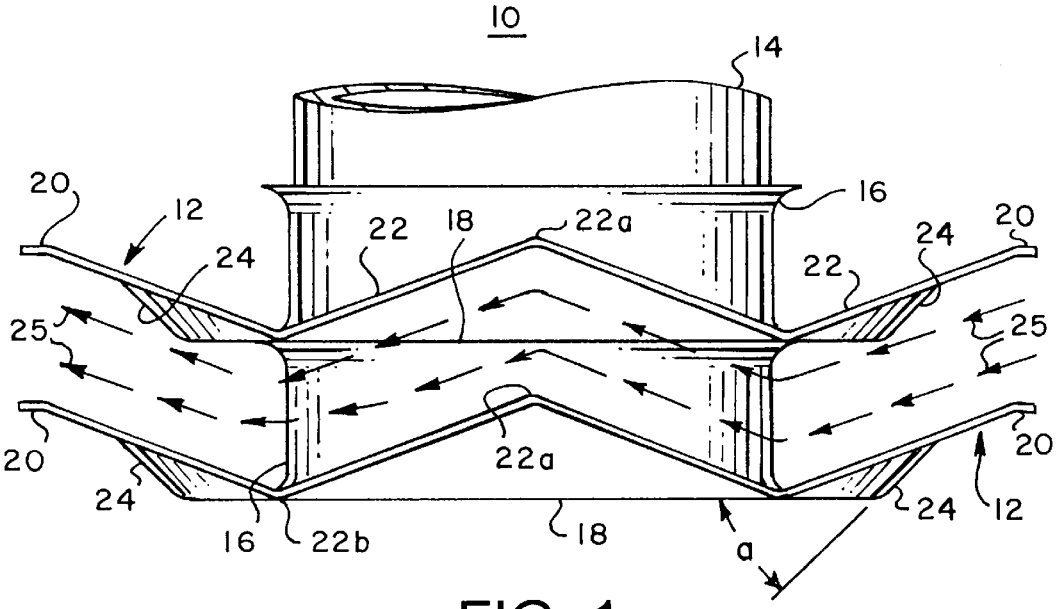
FIG. 1 PRIOR ART
FIG. 1 is an end elevation view of a portion of a heat exchanger, showing two prior art fins of a first type in closely spaced, generally parallel relationship and a tube extending through respective aligned openings in the fins.
Figure 2:
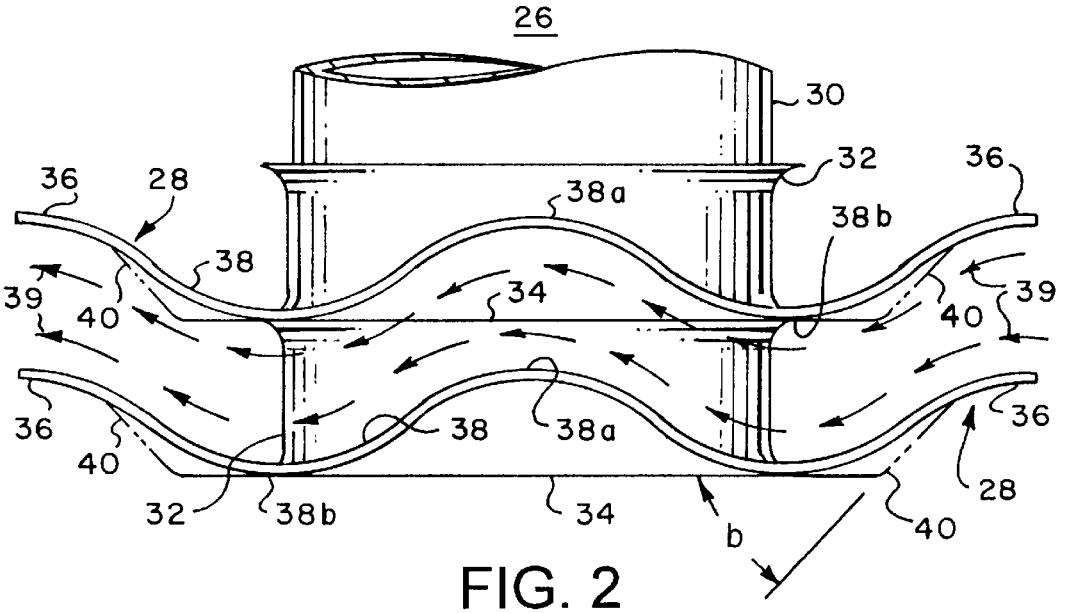
FIG. 2 PRIOR ART
FIG. 2 is an end elevation view of a portion of a heat exchanger, showing two prior art fins of a second type in closely spaced, generally parallel relationship and a tube extending through respective aligned openings in the fins.

It will be helpful in understanding the best mode for carrying out the invention to first describe examples of prior art heat exchanger fins, which are shown in FIGS. 1 and 2. Referring to FIG. 1, a portion of a heat exchanger 10 is depicted, showing two fins 12 in closely spaced, generally parallel relationship with a heat transfer fluid carrying tube 14 extending through respective aligned openings in fins 12. Each fin 12 is comprised of a relatively thin sheet of heat conductive material having a major dimension and a minor dimension, with plural generally cylindrical collars 16 projecting from a major surface thereof. An annular base portion 18 surrounds each collar 16. Collars 16 typically are arranged in one or more rows, with each row being spaced at predetermined intervals and aligned along an axis parallel to the major dimension of the corresponding fin 12, to accommodate one or more rows of tubes 14. The width of each fin 12, as measured transversely across a minor dimension thereof between flat regions 20 on respective opposed sides of the corresponding fin 12, depends on the number of rows of tubes 14 which the particular fin 12 is designed to accommodate. Although only two fins 12 are shown in FIG. 1 and each fin 12 is depicted as having a width sufficient to accommodate only one row of tubes 14, one skilled in the art will recognize that typically heat exchanger 10 could include more than two fins 12 and each fin 12 could be configured to accommodate more than one row of tubes 14.

Each fin 12 is formed with plural corrugations 22, which define a generally triangular wave pattern extending transversely across the minor dimension of the corresponding fin 12. Corrugations 22 extend between opposed flat regions 20. In. FIG. 1, corrugations 22 define two complete wave cycles between opposed flat regions 20. Each fin 12 is shaped around each base portion 18 thereof in the form of shallow, annular frusto-conical regions 24, which define a transition between corrugations 22 and the corresponding base portion 18. Each frusto-conical region 24 is sloped upwardly at an angle a (e.g., 45°) with respect to a nominal plane of fin 12 defined by annular base portions 18 thereof, from the corresponding base portion 18 to corrugations 22.

Typically, a larger fin spacing is required when a heat exchanger is used in a refrigeration system as opposed to an air conditioning system because the lower temperatures under which refrigeration systems operate may cause frost buildup on the tubes and fins, thereby restricting air flow through the heat exchanger if the fin spacing is too tight. Further, larger fin spacings are normally required when a heat exchanger is used in a relatively dirty or dusty environment, such as in a vending machine, where dirt accumulation on the tubes and fins can impede airflow. However, the larger fin spacing reduces heat transfer efficiency because there is more space between adjacent fins for the air to flow without interruption, as depicted by flow arrows 25 in FIG. 1. For example, if heat exchanger 10 is used as an evaporator in a refrigeration system, the height of corrugations 22, as measured between a crest 22*a* and an adjacent trough 22*b* thereof in a direction normal to the nominal plane of fin 12, may be about 0.040 to 0.100 inch and the fin spacing may be about 0.166 (i.e., the fin spacing is greater than the corrugation height). In this case, the corrugation height is not great enough to bend a sufficient volume of the air passing between adjacent fins 12 to cause it to follow the contours of corrugations 22 and come into contact with the surfaces of fins 12. Instead, at least a substantial volume of air tends to flow between fins 12 and not come into contact with the surfaces of fins 12, which detracts from heat transfer efficiency.

Referring now to FIG. 2, a portion of a heat exchanger 26 is depicted, showing two fins 28 in closely spaced, generally parallel relationship with a heat transfer fluid carrying tube 30 extending through respective aligned openings in fins 28. Each fin 28 is comprised of a relatively thin sheet of heat conductive material having a major dimension and a minor dimension, with plural generally cylindrical collars 32 projecting from a major surface thereof. An annular base portion 34 surrounds each collar 32. Collars 32 typically are arranged in one or more rows, with each row being spaced at predetermined intervals and aligned along an axis parallel to the major dimension of the corresponding fin 28, to accommodate one or more rows of tubes 30. The width of each fin 28, as measured transversely across a minor dimension of the corresponding fin 28 between flat regions 36 on respective opposed sides thereof depends on the number of rows of tubes 30 which the particular fin 28 is designed to accommodate. Although only two fins 28 are shown in FIG. 2 and each fin 28 is depicted as having a width sufficient to accommodate only one row of tubes 30, one skilled in the art will recognize that typically heat exchanger 26 could include more than two fins 28 and that each fin 28 could be configured to accommodate more than one row of tubes 30.

Each fin 28 is formed with plural corrugations 38, which in this case define a generally sinusoidal wave pattern extending transversely across the minor dimension of the corresponding fin 28. Corrugations 38 extend between opposed flat regions 36. In. FIG. 2, corrugations 38 define two complete wave cycles between opposed flat regions 36. Each fin 28 is shaped around each base portion 34 thereof in the form of shallow, annular frusto-conical regions 40, which define a transition between corrugations 38 and the corresponding base portion 34. Each frusto-conical region 40 is sloped upwardly at an angle b (e.g., 45°) with respect to a nominal plane of fin 28 defined by annular base portions 34, from the corresponding base portion 34 to corrugations 38.

For example, if heat exchanger 26 is used as an evaporator in a refrigeration system, the height of corrugations 38, as measured between a crest 38*a* and an adjacent trough 38*b* thereof in a direction normal to the nominal plane of fin 28, may be about 0.040 to 0.100 inch and the fin spacing may be about 0.166 inch (i.e., the fin spacing is greater than the corrugation height). In this case, the corrugation height is not great enough to bend a sufficient volume of air passing between fins 28, which is depicted by flow arrows 39, to cause a substantial volume of air to follow the contours of corrugations 38 and come into contact with the surfaces of fins 28. Instead, at least a substantial volume of air tends to flow between fins 28 and not come into contact with the surfaces of fins 28, which detracts from heat transfer efficiency.

Figure 4:
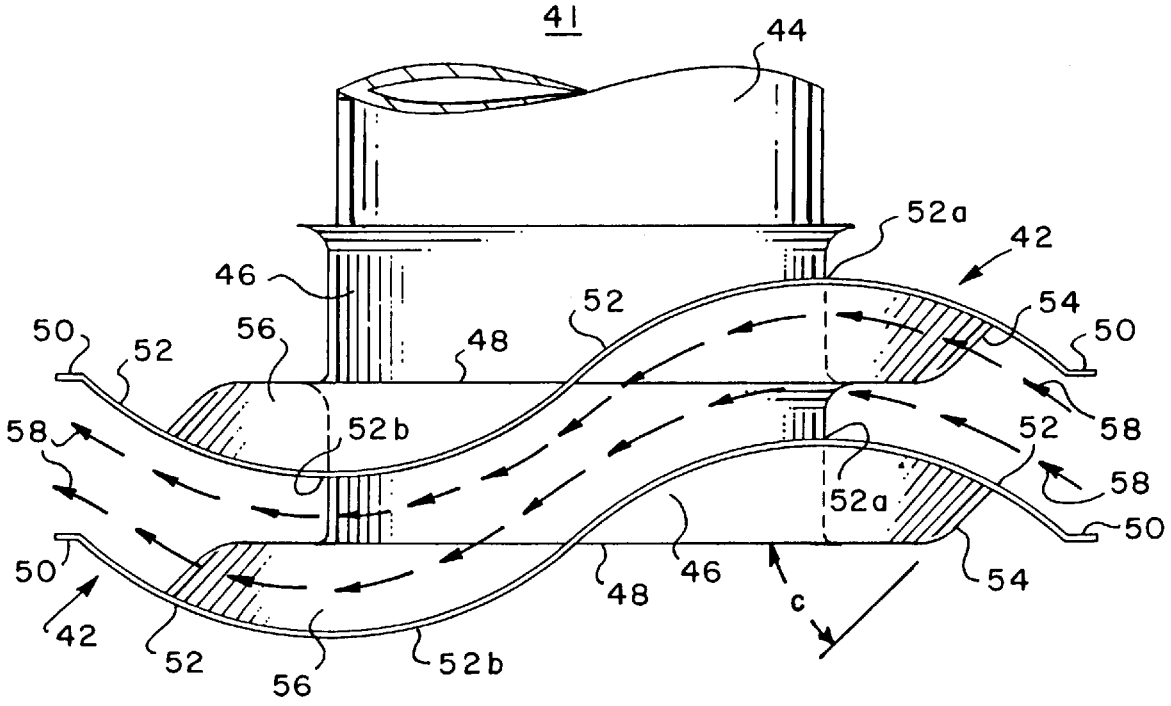
FIG. 4 is an end elevation view of a portion of a heat exchanger, showing two fins, according to the present invention, in closely spaced, generally parallel relationship and a tube extending through respective aligned openings in the fins.
Figure 6:
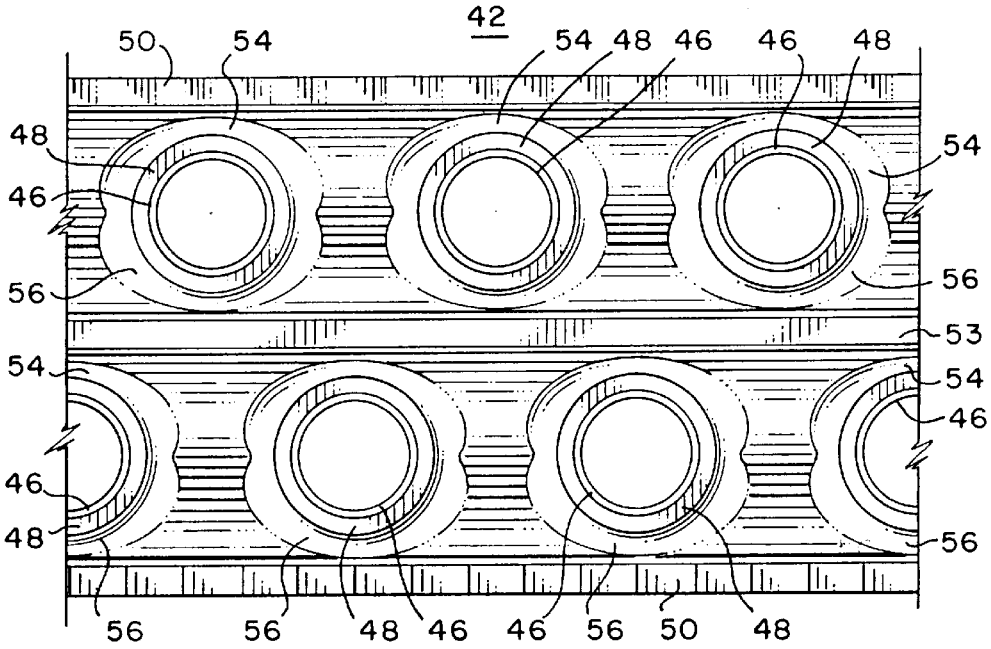
FIG. 6 is a plan view of one of the fins of FIG. 4, which is configured to accommodate two rows of heat exchanger tubes.
Figure 7:
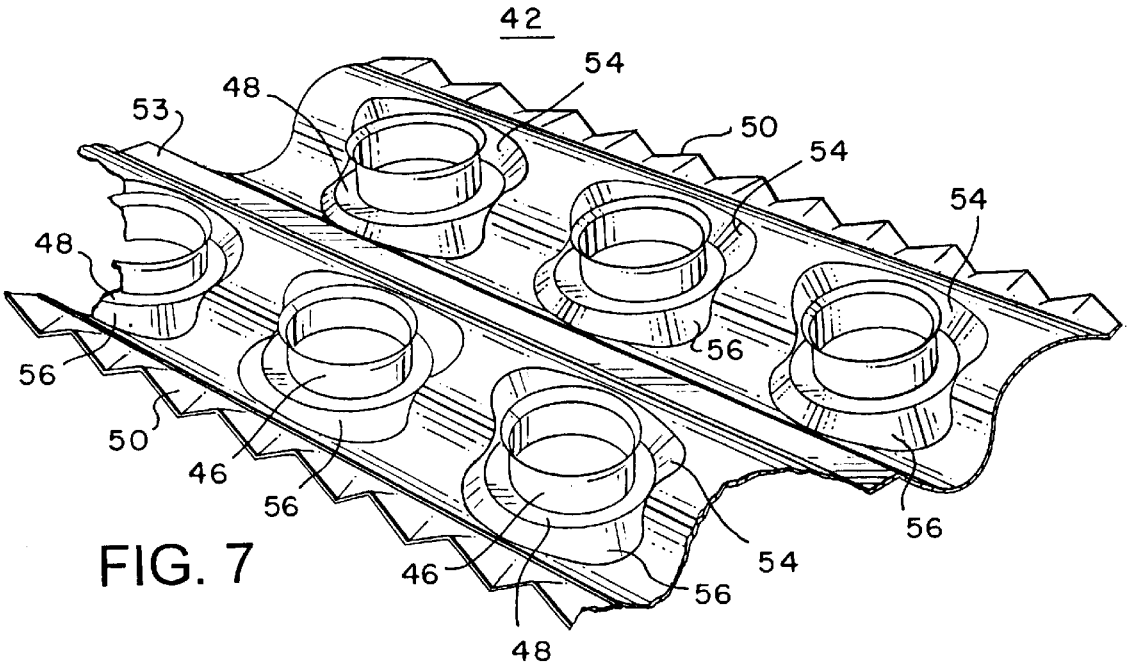
FIG. 7 is a perspective view of the fin of FIG. 6.

Referring now to FIG. 4, a portion of a heat exchanger 41 is depicted, showing two fins 42 according to the present invention in closely spaced, generally parallel relationship with a heat transfer fluid carrying tube 44 extending through respective aligned openings in fins 42. Referring also to FIGS. 6 and 7, each fin 42 is comprised of a relatively thin sheet of heat conductive material having a major dimension and a minor dimension, with plural generally cylindrical collars 46 projecting from a major surface thereof An annular base portion 48 surrounds each collar 46. Collars 46 are typically arranged in one or more rows, with each row being spaced at predetermined intervals and aligned along a longitudinal axis of the corresponding fin 42, which is parallel to the major dimension thereof, to accommodate one or more rows of tubes 44. The width of each fin 42, as measured transversely across a minor dimension thereof between flat regions 50 on respective opposed sides of the corresponding fin 42, depends on the number of rows of tubes 44 which the particular fin 42 is designed to accommodate. Flat regions 50 extend longitudinally along each fin 42 on respective opposite sides thereof and are relatively thin (e.g., about 0.03 inch in a transverse direction).

Although only two fins 42 are shown in FIG. 4 and each fin 42 is depicted as having a width sufficient to accommodate only one row of tubes 44, one skilled in the art will recognize that heat exchanger 41 typically could include more than two fins 42 and that each fin 42 typically could be configured to accommodate more than one row of tubes 44. For example, in FIGS. 6 and 7, a fin 42 is depicted with two rows of collars 46 for receiving two rows of heat exchanger tubes (not shown in FIGS. 6 and 7). The individual collars 46 of each row are aligned along a longitudinal axis of fin 42. Further, as can be best seen in FIG. 7, opposed flat regions 50 are rippled.

Each fin 42 is formed with plural corrugations 52, which define a generally sinusoidal wave pattern extending transversely across the minor dimension of the corresponding fin 42. Corrugations 52 extend between opposed flat regions 50. In FIG. 4, which shows fin 42 with only one row of collars 46, corrugations 52 define one complete wave cycle between opposed flat regions 50. In FIGS. 6 and 7, which shows fin 42 with two rows of collars 46, corrugations 52 define two complete sine wave cycles with a longitudinally extending flat region 53 being between the two wave cycles. Each fin is shaped around each base portion 48 thereof in the form of two shallow, semi-annular frusto-conical regions 54, 56, which define transition regions between corrugations 52 and the corresponding base portion 48. Each frusto-conical region 54 is sloped upwardly at an angle c (e.g., 45°) with respect to a nominal plane of the corresponding fin 42 defined by base portions 48 thereof, from the corresponding base portion 48 to a first portion 52*a* of corrugations 52 on one side of a corresponding longitudinal axis of fin 42. Each frusto-conical region 56 is sloped downwardly at an angle c (e.g., 45°) with respect to the nominal plane of fin 42, from the corresponding base portion 48 to a second portion 52*b* of corrugations 52 on an opposite side of the corresponding longitudinal axis of fin 42. As can be best seen in FIG. 4, first portion 52*a* is above the nominal plane of fin 42 and second portion 52*b* is below the nominal plane of fin 42.

As can be best seen in FIG. 4, the height of corrugations 52, as measured between the crest of first portion 52*a* and the trough of second portion 52*b* in a direction normal to the nominal plane of fin 42, is greater than the spacing between adjacent fins 42 when heat exchanger 41 is used in a typical refrigeration system or in a relatively dirty or dusty environment, which is in contrast to the prior art fins 12 and 28 described hereinabove with reference to FIGS. 1 and 2. For example, assuming a spacing between adjacent fins 42 of about 0.166 inch in heat exchanger 40 (i.e., the same spacing as in prior art heat exchangers 10 and 26), the height of corrugations 52 is about 0.200 inch, which is twice the height of corrugations 22, 38 in prior art fins 12, 28, respectively. The greater height of corrugations 52 bends the flow of air through heat exchanger 41 to a greater extent than in prior art fins 12, 28, as indicated by flow arrows 58, thereby causing more air to follow the contours of corrugations 52 and come into contact with the surfaces of fins 41, to enhance heat transfer efficiency.

Figure 3:
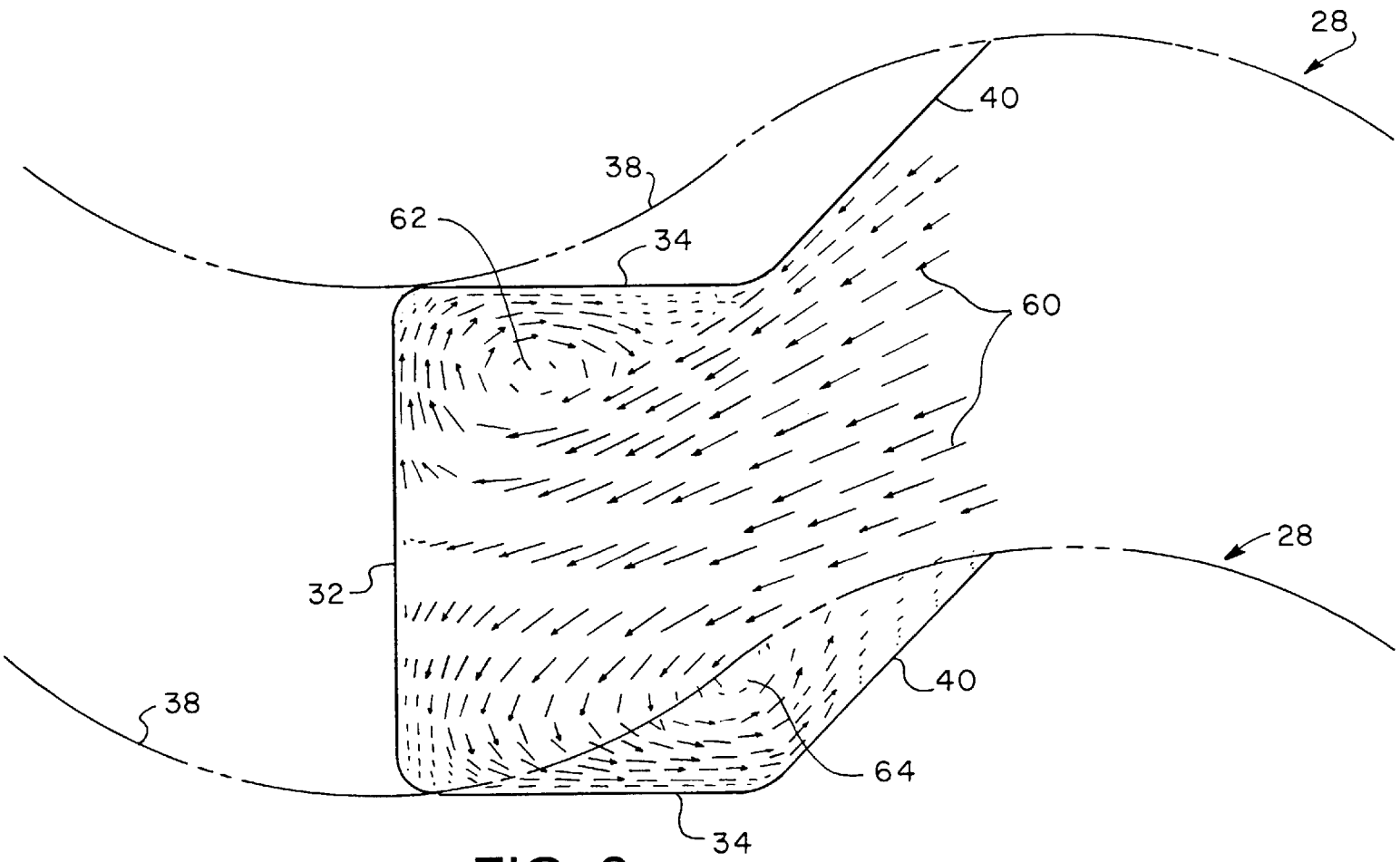
FIG. 3 PRIOR ART
FIG. 3 is a detailed view showing predicted air flow between the fins of FIG. 2, upstream of and adjacent to a fin collar.

In addition to enhancing heat transfer by causing a greater volume of air to come into contact with the surfaces of fins 42, it is believed that heat transfer is also enhanced by vortex action in the vicinity of each collar 46, as will now be described in greater detail hereinbelow with reference to FIGS. 3 and 5. FIG. 3 depicts the flow of air, as represented by arrows 60, between two prior art fins 28 upstream of a fin collar 32. FIG. 3 is a detailed view of a right side portion of FIG. 2. As air passes between fins 28 in a direction generally parallel to the respective minor dimensions of fins 28, at least some of the air will encounter collars 32. As air encounters a collar 32, it is directed downwardly by the downwardly sloped frusto-conical regions 40 of adjacent fins 28 and contacts the generally cylindrical surface of collar 32, whereupon a generally clockwise vortex 62 and a generally counterclockwise vortex 64 are formed upstream of collar 32. Vortices 62, 64 further enhance heat transfer between the airflow and fins 28.

Figure 5:
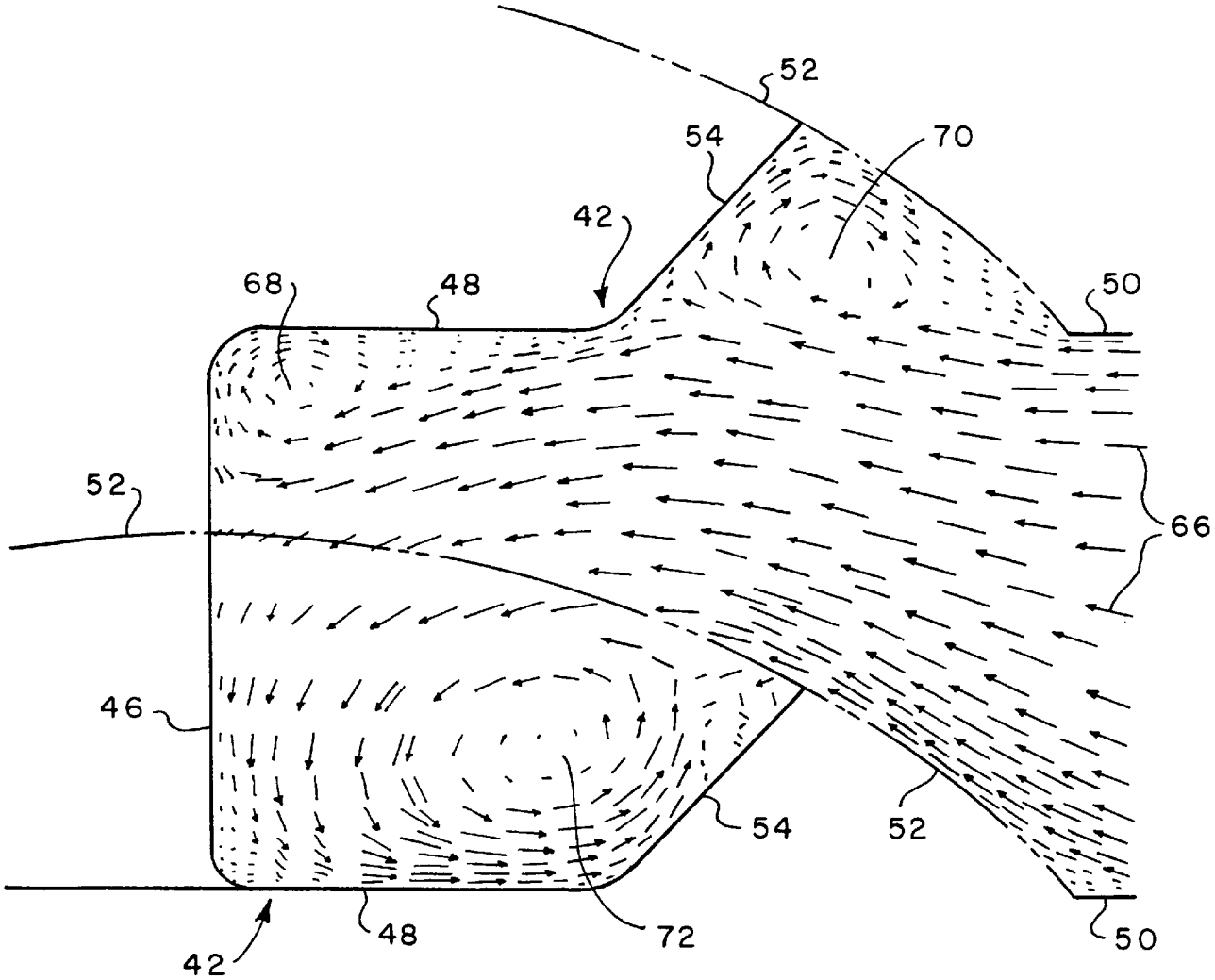
FIG. 5 is a detailed view showing predicted air flow between the fins of FIG. 4, upstream of and adjacent to a fin collar.

FIG. 5 is a detailed view of a right side portion of FIG. 4, showing the flow of air, as depicted by arrows 66, between two fins 42, according to the present invention, upstream of a fin collar 46. As air passes between fins 42 in a direction generally parallel to the respective minor dimensions of fins 42, at least some of the air will encounter collars 46. As air encounters a collar 46, it is directed upwardly by first portion 52*a* of corrugations 52 of the lower fin 42 and contacts the generally cylindrical surface of collar 46, a first generally clockwise vortex 68 is formed proximate to collar 46 and a second generally clockwise vortex 70 is formed proximate to frusto-conical region 54 of upper fin 42 (as viewed in FIG. 5). Similarly, a generally counterclockwise vortex 72 is formed in the region between collar 46 and first frusto-conical region 54 of lower fin 42. This counterclockwise vortex 72 is substantially larger than the comparable counterclockwise vortex 64 in FIG. 3, thereby resulting in greater heat transfer between the air and lower fin 42 than the corresponding heat transfer between the air and lower fin 28 (as viewed in FIG. 3).

Although it is expected that heat transfer between the air and fin 42 would be enhanced because of the greater bending of the air as it passes between adjacent fins 42, the increased heat transfer between the air and fins 42 due to vortex action is an unexpected result. It is believed that this increased vortex action is due to the greater height of corrugations 52, which direct the air more upwardly so that a "lee" is formed between first frusto-conical regions 54 and the corresponding collars 46 of lower fin 42, to allow a larger generally counterclockwise vortex 72 to form as compared to the generally counterclockwise vortex 64 shown in FIG. 3. Comparative testing of a heat exchanger equipped with prior art fins 28 having corrugation heights of about 0.100 inch and fin spacings of about 0.166 inch (which equates to 6 fins per inch) and a heat exchanger equipped with fins 42, according to the present invention, having corrugation heights of about 0.200 with the same fin spacings (i.e., about 0.166 inch or 6 fins per inch) has shown that fins 42 provide an improvement of approximately 2% to 4% in heat transfer efficiency at various airflow rates from 200–800 feet per minute. The best results occurred at the higher flow rates (i.e. 500–800 feet per minute). Further, such comparative testing indicated no appreciable air side pressure drop in the heat exchanger equipped with fins 42 according to the present invention, as compared with the heat exchanger equipped with prior art fins 28.

Increased heat transfer without increased air side pressure drop was also an unexpected result and clearly demonstrated the advantages of fin 42 according to the present invention, particularly at relatively large fin spacings (e.g., 2 to 8 fins per inch), such as in refrigeration system applications. Since the fin spacing was the same in the aforementioned comparative testing, it is believed that the improvement in heat transfer performance is attributable to the greater height of corrugations 52 in fin 42 as compared to the height of corrugations 38 in prior art fins 28 (0.200 inch versus 0.100 inch). However, the fact that the improved heat transfer was not accompanied by higher air side pressure drop was unexpected.

In accordance with the present invention, an improved heat exchanger fin is provided which substantially increases heat transfer efficiency without substantially increasing air side pressure drop. The heat exchanger fin according to the present invention is particularly well-suited for use in refrigeration systems and in relatively dirty or dusty environments, such as in vending machines, where the fin spacings are larger than in typical air conditioning systems. However, the fin is also suitable for use in typical air conditioning systems.

The best mode for carrying out the invention has now been described in detail. Since changes in and modifications to the above-described best mode may be made without departing from the nature, spirit or scope of the invention, the invention is not limited to said details, but only by the appended claims and their equivalents.

We claim:

1. A fin for use in assembling a heat exchanger having a plurality of said fins arranged in substantially parallel array and a plurality of heat transfer tubes passing through aligned openings in said fins and in intimate contact therewith to allow a heat transfer medium flowing inside the tubes to exchange heat with another heat transfer medium flowing across said fins and outside of the tubes, said fin comprising:

a relatively thin sheet of heat conductive material having plural collars formed around respective openings in said fin, said collars having respective annular base portions which define a nominal plane of said fin, said fin having a major dimension and a minor dimension, said sheet being formed into corrugations defining a predetermined wave pattern across said minor dimension, a first portion of said corrugations being above said nominal plane and a second portion of said corrugations being below said nominal plane, said first portion corresponding to a crest of said wave pattern and said second portion corresponding to a trough of said wave pattern, said fin being shaped around the annular base portion of each collar thereon in the form of a shallow, semi-annular first frusto-conical region that slopes upwardly from said base portion to said first portion of said corrugations on one side of a longitudinal axis of said fin and a shallow, semi-annular second frusto-conical region that slopes downwardly from said base portion to said second portion of said corrugations on an opposite side of said longitudinal axis.

2. The fin of claim 1 wherein said wave pattern has a wavelength approximately equal to a width of said fin across said minor dimension.

3. The fin of claim 1 wherein said wave pattern is a generally sinusoidal wave pattern in a transverse direction across said minor dimension.

4. The fin of claim 1 wherein said corrugations have a height of about 0.200 inch when plural ones of said fin are assembled in a heat exchanger with said spacing being about 6 fins per inch.

5. The fin of claim 1 wherein said corrugations have a height, as measured in a direction normal to said nominal plane, which is greater than a spacing between adjacent fins when plural ones of said fins are assembled in a heat exchanger with a spacing between adjacent fins being in a range from about 2 to 8 fins per inch.

6. The fin of claim 1 wherein said corrugations have a height, as measured in a direction normal to the nominal plane of said fin, which is greater than a spacing between adjacent fins when plural ones of said fin are assembled in a heat exchanger.

7. A heat exchanger, comprising:

plural fins arranged in substantially parallel array, each of said fins having plural openings, a major dimension and a minor dimension; and a plurality of heat transfer tubes passing through respective aligned openings in said fins and in intimate contact therewith to allow a heat transfer medium flowing inside said tubes to exchange heat with another heat transfer medium flowing across said fins and outside of said tubes;

each of said fins being comprised of a relatively thin sheet of heat conductive material having plural collars formed around respective openings in said fin, said collars having respective annular base portions defining a nominal plane of said fin, said sheet being formed into corrugations having a height, as measured in a direction normal to the nominal plane of said fin, which is greater than a spacing between adjacent fins in said parallel array, said corrugations defining a predetermined wave pattern across said minor dimension, a first portion of the corrugations on each fin being above the nominal plane of said fin and a second portion of the corrugations on each fin being below the nominal plane of said fin, said first portion corresponding to a crest of said wave pattern, said second portion corresponding to a trough of said wave pattern, each fin being shaped around the annular base portion of each collar thereon in the form of a shallow, semi-annular first frusto-conical region that slopes upwardly from said base portion to said first portion of said corrugations on one side of a longitudinal axis of said fin and a shallow, semi-annular second frusto-conical region that slopes downwardly from said base portion to said second portion of said corrugations on an opposite side of said longitudinal axis.

8. The heat exchanger of claim 7 wherein said wave pattern has a wavelength approximately equal to a width of each fin across said minor dimension.

9. The heat exchanger of claim 7 wherein said wave pattern is a generally sinusoidal wave pattern in a transverse direction across said minor dimension.

10. The heat exchanger of claim 7 wherein said spacing is in a range from about 2 to 8 fins per inch.

11. The heat exchanger of claim 7 wherein the height of said corrugations is about 0.200 inch and said spacing is about 6 fins per inch.

12. A heat exchanger, comprising:

plural fins arranged in substantially parallel array, each of said fins having plural openings, a major dimension and a minor dimension; and a plurality of heat transfer tubes passing through respective aligned openings in said fins and in intimate contact therewith to allow a heat transfer medium flowing inside said tubes to exchange heat with another heat transfer medium flowing across said fins and outside of said tubes;

each of said fins being comprised of a relatively thin sheet of heat conductive material having plural collars formed around respective openings in said fin, said collars having respective annular base portions defining a nominal plane of said fin, said sheet being formed into corrugations defining a predetermined wave pattern across said minor dimension, a first portion of the corrugations on each fin being above the nominal plane of said fin and a second portion of the corrugations on each fin being below the nominal plane of said fin, said first portion corresponding to a crest of said wave pattern, said second portion corresponding to a trough of said wave pattern, each fin being shaped around the annular base portion of each collar thereon in the form of a shallow, semi-annular first frusto-conical region that slopes upwardly from said base portion to said first portion of said corrugations on one side of a longitudinal axis of said fin and a shallow, semi-annular second frusto-conical region that slopes downwardly from said base portion to said second portion of said corrugations on an opposite side of said longitudinal axis.

13. The heat exchanger of claim 12 wherein said wave pattern has a wavelength approximately equal to a width of each fin across the minor dimension thereof.

14. The heat exchanger of claim 12 wherein said wave pattern is a generally sinusoidal wave pattern in a transverse direction across said minor dimension.

* * * * *